US005727263A

United States Patent [19]

Hugo Ceja Estrada

[11] Patent Number: 5,727,263

[45] Date of Patent: Mar. 17, 1998

[54] TOILET VENTILATION SYSTEM

[76] Inventor: Juan Jose Hugo Ceja Estrada, Aquiles Serdan 123 Sur, 80000, Culiacan Sinaloa, Mexico

[21] Appl. No.: 796,208

[22] Filed: Feb. 7, 1997

Related U.S. Application Data

[63] Continuation of Ser. No. 386,550, Feb. 10, 1995, abandoned.

[51] Int. Cl.[6] ..... E03D 9/04

[52] U.S. Cl. ..... 4/216

[58] Field of Search ..... 4/213, 216, 217, 4/348, 352

[56] References Cited

U.S. PATENT DOCUMENTS

| | | | |
|---|---|---|---|
| 704,471 | 7/1902 | Brown . | |
| 1,061,522 | 5/1913 | Brader et al. | 4/352 |
| 1,441,007 | 1/1923 | Littlefield . | |
| 1,498,890 | 6/1924 | Steedman | 3/85 |
| 1,507,737 | 9/1924 | James | 3/85 |
| 1,794,656 | 3/1931 | Thompson | 3/85 |
| 2,127,010 | 8/1938 | Sampson | 3/32 |
| 2,452,282 | 10/1948 | Auer | 4/216 X |
| 2,619,655 | 12/1952 | Huff | 4/213 |
| 2,646,574 | 7/1953 | Gillespie . | |
| 3,045,342 | 7/1962 | Diehl | 3/85 |
| 3,064,274 | 11/1962 | Gleason | 4/216 |
| 3,273,170 | 9/1966 | Wheeler | 4/348 |
| 3,333,285 | 8/1967 | Null | 4/217 |
| 4,222,129 | 9/1980 | Baker | 4/216 X |
| 4,285,124 | 8/1981 | Diakonov | 3/32 |
| 4,461,078 | 7/1984 | Carreker | 3/47 |
| 4,617,687 | 10/1986 | Wadsworth . | |
| 4,993,083 | 2/1991 | Lemieux | 4/216 X |
| 5,029,346 | 7/1991 | Fernald . | |
| 5,167,039 | 12/1992 | Sim | 4/216 |
| 5,259,072 | 11/1993 | Trombley . | |
| 5,305,473 | 4/1994 | Nakamura . | |
| 5,353,443 | 10/1994 | Sim . | |
| 5,369,812 | 12/1994 | Trombley . | |

FOREIGN PATENT DOCUMENTS

| | | | |
|---|---|---|---|
| 2943641 | 5/1980 | Germany | 4/348 |

*Primary Examiner*—Charles E. Phillips
*Attorney, Agent, or Firm*—Donald J. Lenkszus

[57] ABSTRACT

A urinal or toilet ventilation system for removing unpleasant odors from the vicinity of the urinal or toilet, both during usage and for a short period of time following usage. The ventilation system has a series of flexible water ducts extending throughout the device and leading to the outside. Additionally, the device has a series of air ducts extending throughout the device and attaching to a motor which in turns pushes the air through another series of ducts leading to the outside. In a further embodiment the urinal or toilet has a sensor to detect the presence of a user for actuating the motor and begins the air extraction system. Upon the user leaving the vicinity of the urinal or toilet, the sensor has a built in delay, and continues to extract any unpleasant odors for a short duration.

14 Claims, 3 Drawing Sheets

TOILET VENTILATION SYSTEM

This is a continuation of Ser. No. 386,550 filed Feb. 10, 1995, now abandoned.

FIELD OF THE INVENTION

The present invention relates to a toilet or a urinal having a ventilation system for removing unpleasant odors from the room in which the toilet or urinal is located, and to such a ventilation system actuated by a sensor to operate during the presence of a person utilizing such facilities.

BACKGROUND OF THE INVENTION

Toilet, or toilet, and urinals in the marketplace may have an attachment on the drainpipe which prevents the unpleasant odors released into the sewers from returning. Such attachments operate isolate unpleasant odors only after conclusion of the use of the toilet or urinal device, but does not address the odors produced during the use of the toilet or urinal. However, a ventilation system that operates to remove unpleasant odors during the use of the toilet or urinal has not yet been achieved.

Devices for removing unpleasant odors from the area of a toilet or urinal device are known. For example, U.S. Pat. No. 5,305,473 to Nakamura discloses a urinal having a smell release function. The Nakamura urinal releases the smell of unpleasant odors without the use of a smell release duct. Rather, the Nakamura urinal shell has an air space formed within the urinal shell with smell release ports for drawing the offensive air generated in the urinal into the air space. The offensive smell is then released from the vicinity of the urinal through a drain pipe. As a result, the urinal disclosed does not have a means for sensing the presence of a person. Furthermore, the urinal disclosed does not comprise a means for releasing unpleasant odors from the room until such time as the user has finished using the urinal.

Other examples of patented toilets and urinals for releasing unpleasant odors from the vicinity include: U.S. Pat. No. 2,646,574 to Gillespie disclosing an odorless urinal with strategically displaced vents; and U.S. Pat. No. 704,471 to Brown disclosing a ventilator attachment to toilets.

While each of the above described toilets and urinals for releasing odors form the vicinity of the urinal function adequately, they each have drawbacks. The major drawback is that the urinal does not have a sensor for detecting the presence of a user of the urinal. Furthermore, the patents described above which disclose urinals that have an odor removing mechanism, do not have a means for releasing the unpleasant odor until such time as the user has concluded their visit to the urinal.

Therefore, what is desirable is a toilet or urinal device with a sensor for detecting the presence of a user, wherein, the unit has a means for releasing unpleasant odors from the vicinity at the time the toilet or urinal is being used and until such time as the user has concluded their visit.

SUMMARY OF THE INVENTION

It is therefore an object of the present invention to provide a toilet or urinal device for effectively removing unpleasant odors from the vicinity of the device.

Additionally, it is a further object of the invention to provide a device for a toilet or urinal for removing unpleasant odors during use of the toilet or urinal.

Furthermore, it is a further object of the invention to provide a device for a toilet or urinal having a sensor for detecting the presence of a user.

In accordance with the invention, a device for a toilet or urinal is disclosed, comprising a motor and a series of air ducts and water ducts attached thereto. The ducts attach to an adjacent set of pipes which lead to an outside area. In addition, the toilet or urinal comprises a sensor which acts as a switch for activating the motor upon the presence of a user.

BRIEF DESCRIPTION OF THE DRAWINGS

The present invention will now be described in detail with reference to the attached drawings in which.

DETAILED DESCRIPTION OF THE PREFERRED EMBODIMENTS

Toilets and urinals to date have introduced methods relating to the release of unpleasant odors created during the use of the device. Some devices provide ventilation systems which activate upon the end of the users visit. However, none of the toilets or urinal devices to date solve the problem encountered with releasing unpleasant odors during actual use of the device.

In the prior art, the toilets and urinals did not have the ability to sense the presence of a user until such time as his or her visit concluded. Commonly, the toilets and urinals were not capable of removing any unpleasant odors from the room until such time as the user was nearing or at the end of his or her visit. This may result in an unappealing result to the user of the toilet or urinal during use.

Accordingly, the toilet and urinal apparatus disclosed comprises a special design which removes unpleasant odors during use of the toilet or urinal. In the case of a visit to the toilet or urinal which is long in duration and has created unpleasant odors in the process, a device which can remove the unpleasant odors during the visit is very desirable. The toilet and urinal disclosed comprises an air extraction system together with a sensor which becomes activated upon the presence of a user.

Figure 1:
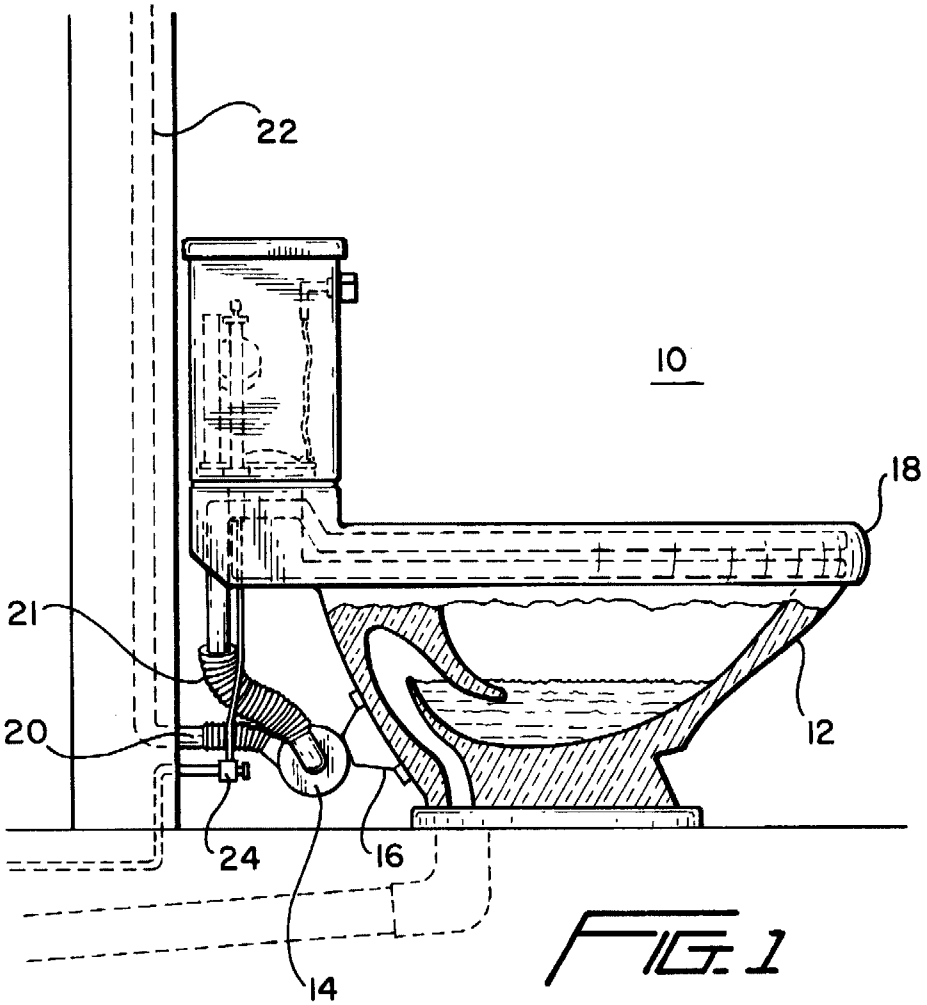
FIG. 1 is a cross sectional view of one embodiment of the present invention depicting a toilet ventilation system.

FIG. 1 illustrates a novel toilet 10. The toilet 10 includes a commode unit 12 comprising a metallic base 16 and a motor extractor 14 affixed to the commode by means of the metallic base 16. The upper portion of the commode 12 has a rim 18. A pair of hoses 20 and 21 are attached to the motor-extractor 14 at one end, and are attached to the commode 12 through the rim 18. Additionally, the motor extractor 14 has a second hose 20 attached thereto which is attached to a pipe 22 leading to an outside area. The toilet 10 further comprises a control faucet 24 for controlling the flow of water to the toilet.

Figure 2:
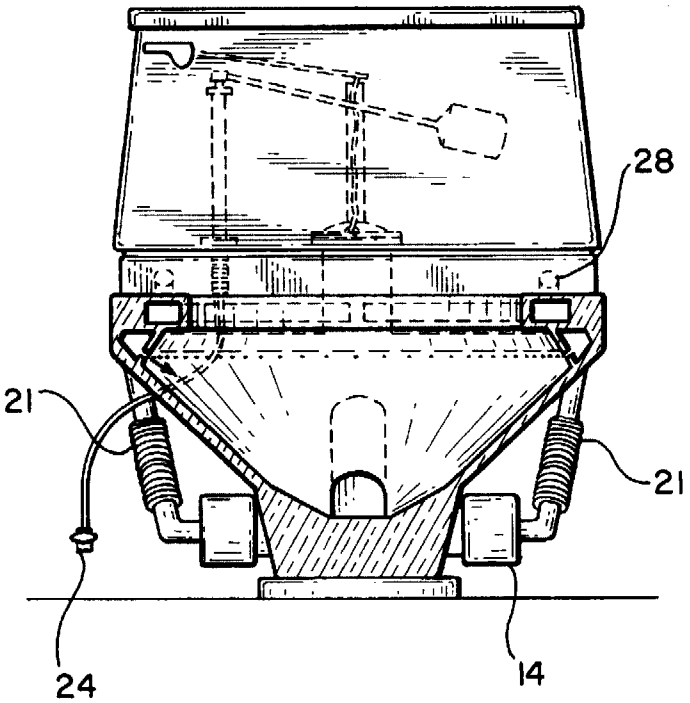
FIG. 2 is a frontal view of the toilet ventilation system depicted in FIG. 1.

FIG. 2 illustrates a front view of the toilet apparatus 10 showing the positioning of the motor 14 with respect to the apparatus. The hose 21 is attached at its lower end to the motor 14 and at its upper end into the top portion of the rim 18.

Figure 3:
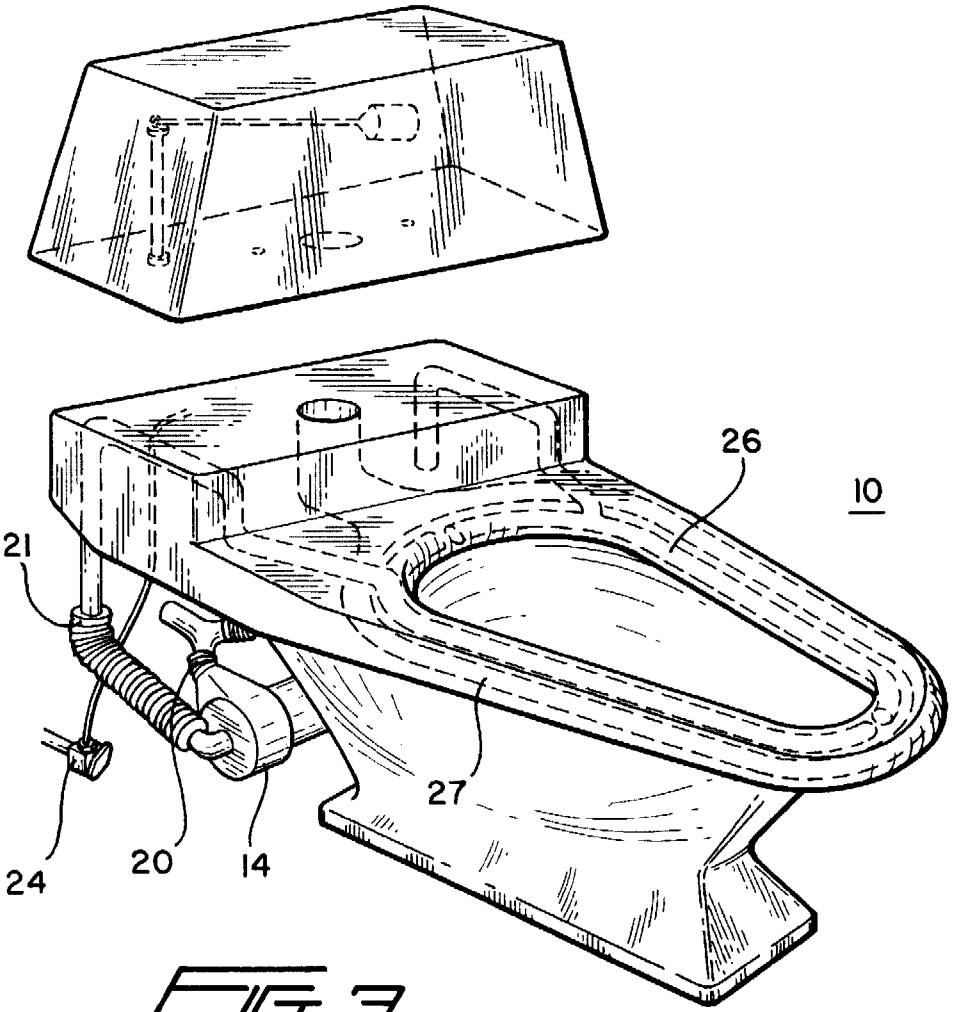
FIG. 3 is a sectional view of the air ducts and water disposition within the toilet device depicted in FIGS. 1 and 2.

FIG. 3 illustrates the placement of the hoses 21 into the upper portion of the rim 18 of the toilet 10. The hoses are directly attached to the top portion of the rim 18. The rim 18 has a series of air ducts 26 and water ducts 27 evenly spaced therethrough and attached to the hoses 21. The displacement of the hoses 21 directly to the rim 18 allows the hoses to extract the unpleasant odors during the use of the toilet 10.

Figure 4:
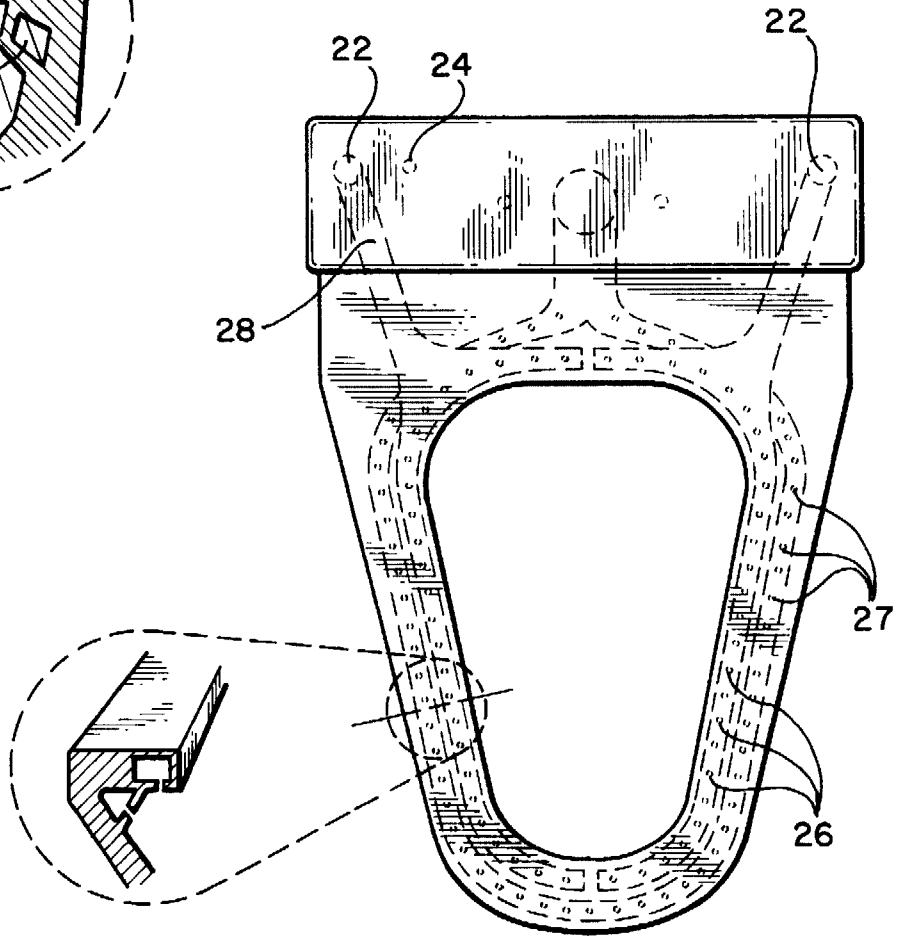
FIG. 4 is a top view of the entire toilet device of FIGS. 1–3 showing a detailed view of the air and water duct system.

FIG. 4 illustrates the configuration of the rim 18 from a top view perspective. The top portion of the rim 18 has air-ducts 26 and water-ducts 27 evenly spaced therethrough. The air-ducts 26 are directly attached to the motor 14 and the water-ducts 27 are directly attached to an inverted cesspool 28.

In a preferred embodiment, the toilet apparatus 10 has a sensor (not shown) displaced on a section of the adjacent wall above the commode 12. The sensor (not shown) acts as a switch for activating the air extraction feature of the unit when the commode is in use. Furthermore, the sensor (not shown) is programmed such that the air extraction system continues to work for a short duration to remove all of the unpleasant air from the vicinity.

Figure 5:
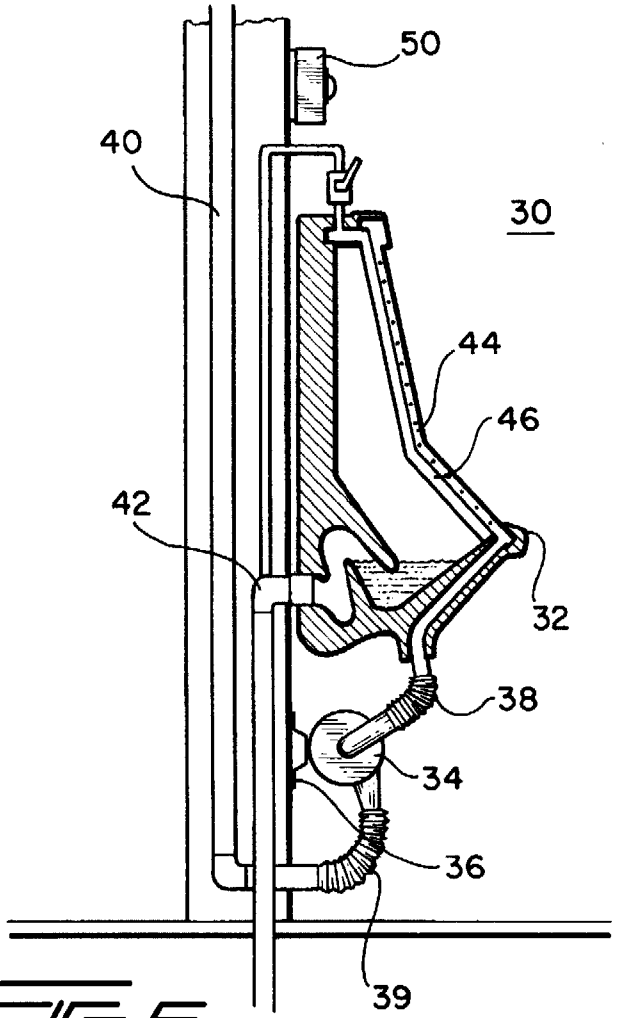
FIG. 5 is a cross-sectional view of another embodiment of the present invention depicting a urinal device with a motor fixed to an adjacent wall.

FIG. 5 illustrates a novel urinal device 30. The urinal device 30 includes the urinal unit 32, having an air-extractor motor 34 fixed to an adjacent wall by means of a metallic base 36. The urinal unit 32 has a pair of ducts or hoses 38 which attaches to the urinal through the front section at a first end and attaches to the extractor motor 34 at a second end. A second duct section 39 attaches to another section of the extractor motor 34 at one end and connects to an air duct pipe 40 in the adjacent wall, leading to the outside. Additionally, the urinal unit 32 has an air duct system 44 and a water duct system 46 running along the sides of the urinal unit 32, and attaching to the water drain 42 and the air duct pipes 40 respectively in the adjacent wall. The displacement of the air ducts 44 and the water ducts 46 enables the motor to extract the unpleasant odors from an area close to the source before any smells permeate the area surrounding the urinal.

In a preferred embodiment, the ducts or hoses connected to the urinal unit 32 and the motor 34 are made of a flexible plastic material. Furthermore, the duct or hose connecting the motor 34 to the air duct pipe 40 is made of a flexible plastic material. The flexibility allows for the ability to replace the motor and the hoses with greater ease, and also allows to install a larger or smaller size motor depending upon what is desired.

Figure 6:
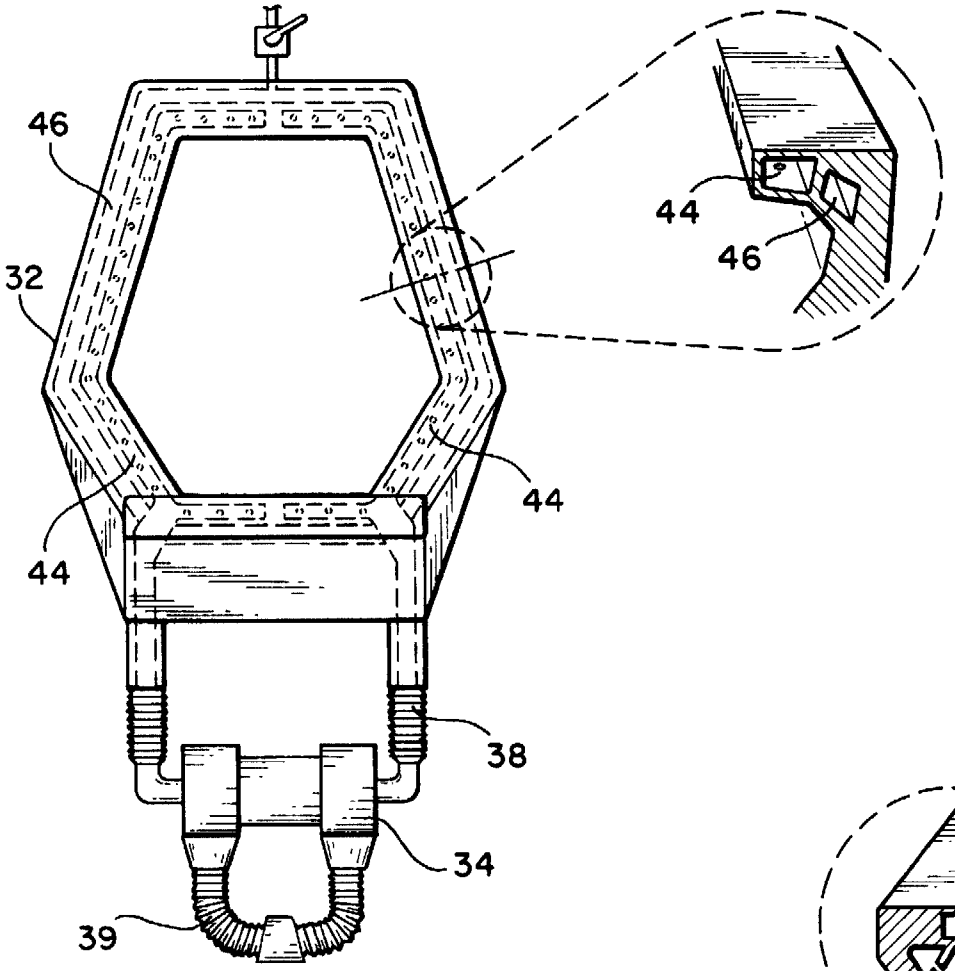
FIG. 6 is a sectional view of the urinal device of FIG. 5 showing a detailed view of the air and water ducts.

FIG. 6 illustrates a front view of the urinal unit 32. This view clearly displays the extractor motor 34 in relation to the unit 32. The flexible air ducts 44 and water ducts 46 are displaced throughout the front section of the urinal 32 and attach to the extractor motor 34 by means of a duct or hose. The ducts or hoses attach to the motor 34 at one end and attach to the pipes 40 and 42 located in the wall adjacent the unit 32 at a second end. The air and water pipes 40 and 42, respectively, remove the air and water to an outside area.

In a preferred embodiment, the urinal unit 32 has a sensor 50 displaced on a section of the adjacent wall above the urinal unit 32. The sensor 50 acts as a switch for activating the air extraction feature of the unit when the urinal is in use. Furthermore, the sensor 50 is programmed such that the air extraction system continues to work for a short duration to remove all of the unpleasant air from the vicinity.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed:

1. A ventilating toilet, comprising:

a water reservoir tank;

a toilet bowl, said bowl comprising a cavity, and an integrally formed rim disposed above and around the periphery of said bowl;

said rim including a first integrally formed duct disposed therein and extending around said bowl, said duct being in fluid communication with said tank, said bowl comprising a plurality of first apertures extending through said rim and in communication with said first duct, said first duct and said plurality of first apertures communicating water from said tank to bowl during flushing of said toilet;

said rim comprises a second duct integrally formed therein, said second duct extending around the periphery of one side of said bowl from the rear thereof to the front thereof, and a plurality of second apertures formed in said rim and in communication with said second duct to provide a ventilation path to exhaust air and odors from the area of said bowl;

said rim comprises a third duct integrally formed therein, said third duct extending around the other side of said periphery of said bowl from the rear thereof to the front thereof, and a plurality of third apertures formed in said rim and in communication with said third duct to provide a second ventilation path to exhaust air and odors from the area of said bowl;

said toilet comprises a rear portion integrally formed with said bowl to support said tank, said rear portion including a first integrally formed duct portion in communication with said second duct at an area of said second duct positioned intermediate the front and rear ends thereof, said first duct portion including at least a first higher duct portion positioned at a higher elevation than said second duct, whereby gravity prevents water from flowing up to said first higher duct portion; and said rear portion further comprises a second integrally formed duct portion in communication with said third duct at an area of said third duct intermediate the front and rear ends thereof, said second duct portion including at least a second higher duct portion positioned at a higher elevation than said third duct, whereby gravity prevents water from flowing up to said first higher duct portion.

2. A ventilating toilet in accordance with claim 1, wherein:

said second duct extends along one side of said rim, and said third duct extends along the opposite side of said rim.

3. A ventilating toilet in accordance with claim 1, wherein;

said toilet comprises a first exhaust aperture integrally formed therein, said first exhaust aperture being in communication with said first higher duct portion, said first exhaust aperture being adapted for connection to an exhaust system.

4. A ventilating toilet in accordance with claim 3, wherein:

said toilet comprises a second exhaust aperture integrally formed therein, said second exhaust aperture being in communication with said second higher duct portion, said second exhaust aperture being adapted for connection to said exhaust system.

5. A ventilating toilet in accordance with claim 1, further characterized in that:

said second duct is positioned above said first duct.

6. A ventilating toilet in accordance with claim 5, wherein:

said toilet comprises a rear portion integrally formed with said bowl to support said tank, said rear portion including an integrally formed duct portion in communication with said second duct, said duct portion including at least a first higher duct portion positioned at a higher elevation than said second duct, whereby gravity prevents water from flowing up to said first higher duct portion.

7. A ventilating toilet in accordance with claim 1, wherein:

said plurality of second apertures is disposed on said rim above and separated from said plurality of first apertures.

8. a ventilating toilet in accordance with claim 1, further including:

an exhaust fan coupled to at least said second duct;

a sensor mounted in the vicinity of said toilet, said sensor being coupled to said exhaust fan and being operable to sense the presence of a person to activate said exhaust fan.

9. A ventilating toilet system in accordance with claim 8, wherein:

said sensor is further operable to maintain said exhaust fan activated for a predetermined time after the presence of said person is no longer sensed.

10. A ventilating toilet system in accordance with claim 8, wherein;

said toilet comprises a first exhaust aperture integrally formed therein, said first exhaust aperture being in communication with said second duct, said first exhaust aperture being coupled to said exhaust fan.

11. A ventilating toilet-system in accordance with claim 10, comprising:

a second exhaust fan;

said toilet comprises a second exhaust aperture integrally formed therein, said second exhaust aperture being in communication with said third duct, said second exhaust aperture being adapted for coupling to said second exhaust fan.

12. A ventilating system in accordance with claim 11, comprising;

means for mounting said first and said second exhaust fans to said toilet.

13. A ventilating system in accordance with claim 11, wherein:

said mounting means comprises a bracket attached to the rear portion of said toilet.

14. A ventilating toilet system in accordance with claim 8, further characterized in that:

said second and third ducts are positioned above said first duct.

* * * * *